US010895241B2

(12) United States Patent
Wollitzer et al.

(10) Patent No.: US 10,895,241 B2
(45) Date of Patent: Jan. 19, 2021

(54) IGNITION DEVICE AND METHOD FOR IGNITING AN AIR/FUEL MIXTURE

(71) Applicant: Rosenberger Hochfrequenztechnik GmbH & Co. KG, Fridolfing (DE)

(72) Inventors: Michael Wollitzer, Fridolfing (DE); Gunnar Armbrecht, Mühldorf am Inn (DE); Martin Fuchs, Freilassing (DE); Peter Awakowicz, Bochum (DE); Thomas Musch, Bochum (DE); Sven Gröger, Bochum (DE); Andre Bergner, Bottrop (DE); Gordon Notzon, Bochum (DE); Marcel Van Delden, Bochum (DE)

(73) Assignee: Rosenberger Hochfrequenztechnik GmbH & Co., Fridolfing (DE)

( * ) Notice: Subject to any disclaimer, the term of this patent is extended or adjusted under 35 U.S.C. 154(b) by 242 days.

(21) Appl. No.: 16/301,525

(22) PCT Filed: May 30, 2017

(86) PCT No.: PCT/EP2017/000632

§ 371 (c)(1),
(2) Date: Nov. 14, 2018

(87) PCT Pub. No.: WO2017/207098

PCT Pub. Date: Dec. 7, 2017

(65) Prior Publication Data

US 2019/0293043 A1 Sep. 26, 2019

(30) Foreign Application Priority Data

Jun. 2, 2016 (DE) ..... 10 2016 006 782

(51) Int. Cl.
*F02P 23/04* (2006.01)
*F02P 3/05* (2006.01)
(Continued)

(52) U.S. Cl.
CPC ..... *F02P 3/05* (2013.01); *F02P 1/083* (2013.01); *F02P 3/0407* (2013.01); *F02P 9/002* (2013.01);
(Continued)

(58) Field of Classification Search
CPC .. F02P 3/05; F02P 3/0407; F02P 9/007; F02P 9/002; F02P 23/045; F02P 1/083; H01T 19/04
(Continued)

(56) References Cited

U.S. PATENT DOCUMENTS 10,753,336 B2 * 8/2020 Wollitzer ..... F02P 9/007

FOREIGN PATENT DOCUMENTS

CN 201802540 U 4/2010
CN 104696136 A 6/2015
(Continued)

*Primary Examiner* — Hai H Huynh
(74) *Attorney, Agent, or Firm* — DeLio Peterson & Curcio LLC; Robert Curcio

(57) ABSTRACT

An ignition device for igniting an air/fuel mixture in at least one combustion chamber, having an ignition system with electrodes for each combustion chamber, a high-voltage source for generating an electrical high-voltage impulse at an output of the high-voltage source, and a high-frequency voltage source for generating an electrical high-frequency alternating voltage, wherein m ignition systems (10*i*) are provided with the formula (I) (natural numbers without zero) and m≥2, wherein κ high-frequency voltage sources are provided with the formula (II), and κ<m, wherein at least one power distributor device is provided which is electrically connected, on the one hand, to at least one high-frequency voltage source and, on the other hand, to n ignition systems, wherein formula (III) and 2≤n≤m, the power distributor device transmits the high-frequency alternating voltage or voltages from the high-frequency voltage source or sources to the ignition systems n.

22 Claims, 5 Drawing Sheets

(51) Int. Cl.

| | |
|---|---|
| ***F02P 1/08*** | (2006.01) |
| ***F02P 9/00*** | (2006.01) |
| ***H01T 19/04*** | (2006.01) |
| ***F02P 3/04*** | (2006.01) |

(52) U.S. Cl.
CPC ..... *F02P 9/007* (2013.01); *H01T 19/04* (2013.01); *F02P 23/045* (2013.01)

(58) Field of Classification Search
USPC ..... 123/143 B, 601, 605, 618
See application file for complete search history.

(56) References Cited

FOREIGN PATENT DOCUMENTS

| | | | |
|---|---|---|---|
| DE | 102004058925 | A1 | 6/2006 |
| DE | 102005036968 | A1 | 2/2007 |
| DE | 102008051185 | A1 | 11/2009 |
| DE | 102013215663 | A1 | 9/2014 |
| DE | 102013112039 | A1 | 4/2015 |
| EP | 2672104 | A2 | 12/2013 |
| EP | 2687714 | | 1/2014 |
| EP | 2881579 | A1 | 6/2015 |
| JP | S57203870 | A | 12/1982 |

* cited by examiner

IGNITION DEVICE AND METHOD FOR IGNITING AN AIR/FUEL MIXTURE

BACKGROUND OF THE INVENTION

1. Field of the Invention

The invention relates to an ignition device for igniting an air/fuel mixture in at least two combustion chambers, in particular of an internal combustion engine, having at least one ignition system with electrodes for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein k high-frequency voltage sources are provided, with $k \in \mathbb{N}$, and $k < m$, wherein at least one power distributor device is provided which is electrically connected, on the one hand, to at least one high-frequency voltage source and, on the other hand, to n ignition systems, wherein $n \in \mathbb{N}$ and $2 \leq n \leq m$, wherein the power distributor device transmits the high-frequency alternating voltage or voltages from the high-frequency voltage source or sources electrically connected to this power distributor device to the n ignition systems which are electrically connected to this power distributor device, according to the applicable claims.

The invention also relates to a method for igniting an air/fuel mixture in m combustion chambers with $m \in \mathbb{N}$ (natural numbers without zero) and $m \geq 2$, in particular of an internal combustion engine, wherein, within a predetermined time interval, an ignitable mixture is generated in at least one combustion chamber, wherein, by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, wherein the electrical high-frequency alternating voltage is fed to the at least two electrodes in the at least one combustion chamber with ignitable mixture before generation of the electrically conductive channel between the at least two electrodes of the respective combustion chamber, according to the applicable claims.

The invention also relates to a method for operating an ignition device for igniting an air/fuel mixture in at least one combustion chamber, in particular of an internal combustion engine, having at least one ignition system for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein the electrical high-frequency alternating voltage at the output of a high-frequency voltage source is fed to n ignition systems, wherein $n \in \mathbb{N}$ and $2 \leq n \leq m$, according to the applicable claims.

The invention also relates to a method for igniting an air/fuel mixture in m combustion chambers with $m \in \mathbb{N}$ (natural numbers without zero) and $m \geq 2$, in particular of an internal combustion engine, wherein, within a predetermined time interval, an ignitable mixture is generated in at least one combustion chamber, wherein, by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, according to the applicable claims.

The numerical quantity $\mathbb{N}$ always refers here to the quantity of natural numbers without zero.

2. Description of Related Art

In order to ignite an air/fuel mixture in an internal combustion engine, atomic (dissociated) oxygen is required which is generated by means of a plasma between the electrodes of a spark plug. Usually, the plasma is a conductive channel (ignition spark) generated by a briefly high electrical voltage, wherein the high electrical voltage is generated by a high-voltage source, for example an ignition coil. Usually, the high electrical voltage is an electrical DC voltage. Innovative ignition systems follow the approach of further maintaining the plasma following this initial ignition spark by means of additional excitation at the electrodes from a second energy source in order to generate more atomic oxygen. This because the demands placed on the ignition system have increased in modern engines due to charging, lean burn, exhaust gas recirculation and stratified charging. In most cases, the second energy source for additional excitation of the plasma generates a high frequency (referred to in the following as HF or high-frequency alternating voltage) and is thus designed in the form of an HF amplifier (also referred to in the following as high-frequency voltage source). Since motor vehicles with internal combustion engines possess more than one spark plug, each spark plug requires its own HF amplifier. However, this is cost- and space-intensive.

The so-called Otto combustion processes with direct fuel injection offer considerable potential for reducing consumption due to the possibility of implementing a stratified charging in the combustion chamber. However, the inhomogeneous mixture in the combustion chamber places increased requirements on the ignition method used in terms of achieving a reliable ignition at the appropriate time. For example, fluctuations of any kind reduce the quality of the ignition and thus the overall efficiency of the engine. On the one hand, the position of the ignitable mixture can vary slightly, and on the other hand the hook of the ground electrode of the spark plug, which projects into the combustion chamber, can interfere with the formation of the mixture. An ignition system with a greater spatial extension into the combustion chamber is helpful for a direct injection combustion process. To this end, DE 10 2004 058 925 A1 suggests igniting an air/fuel mixture in a combustion chamber of an internal combustion engine by means of a high-frequency plasma. A corresponding high-frequency plasma ignition device comprises a series resonant circuit with an inductance and a capacitance and a high-frequency source for resonant excitation of this series resonant circuit. The capacitance is represented by inner and outer conductor electrodes with an interposed dielectric. The outermost ends of these electrodes extend into the combustion chamber spaced apart at a specified distance.

A method for ignition is known from DE 10 2008 051 185 A1 in which a discharge plasma is generated by means of an electrical DC voltage pulse which is then ionised by means of an HF field. The DC voltage pulse and an output signal of an HF generator are thereby fed jointly to a spark electrode of a spark plug. A return electrode of the spark plug is earthed.

Nowadays, modern ignition systems for petrol engines comprise a spark plug and a single ignition coil with electronic control unit. The spark plug has a coaxial structure and consists substantially of a central electrode surrounded by an insulator and an outer electrode which is connected to the spark plug housing. The ignition coil supplies the spark plug with an electrical high-voltage pulse or high DC voltage pulse. A spark (conductive channel) is generated between the electrodes which initiates the combustion. An alternative method in which, in addition to the applied high voltage from the ignition coil, a high-frequency electrical voltage is applied to the spark plug in order to extend the spark firing duration is described in DE 10 2013 215 663 A1.

Known from EP 2 672 104 A2 is an ignition system for an internal combustion engine in which an electromagnetic wave from a single high-frequency source is passed on to four ignition devices via a distributor device. The electromagnetic wave is hereby in each case always fed, together with an ignition pulse, to precisely that combustion chamber in which an ignitable mixture is present. The triggering of an ignition pulse is delayed, so that the ignition process takes place while the electromagnetic wave is being transmitted to the combustion chamber.

Known from JP S57 203870 A is an engine ignition device for igniting lean air/fuel mixtures. Corresponding spark plugs are hereby fed high frequency from a high-frequency generator. An impedance matching is achieved through a corresponding geometrical configuration of the spark plugs.

Known from DE 10 2013 112 039 A1 is a corona ignition system for an internal combustion engine and a method for controlling a corona ignition system. The ignition system comprises an oscillating circuit which contains an ignition electrode, a high-frequency generator connected to the oscillating circuit in order to generate an alternating voltage for exciting the oscillating circuit, a converter to generate an input voltage for the high-frequency generator from the vehicle electrical system voltage, a voltage regulator for stabilising the input voltage generated by the converter for the high-frequency generator, as well as a control unit for controlling the high-frequency generator, wherein the control unit notifies the voltage regulator of an impending change in load of the converter before the change in load takes place through activation or deactivation of the high-frequency generator. A separate high-frequency generator is provided for each combustion chamber. The control unit activates the high-frequency generator when a corona discharge is to be generated in the relevant combustion chamber of the engine.

SUMMARY OF THE INVENTION

The invention is based on the problem of improving an ignition device of the aforementioned type in terms of its structure and function.

According to the invention this problem is solved through an ignition device of the aforementioned type with the characterizing features of the independent claims, through a method for igniting an air/fuel mixture of the aforementioned type with the characterizing features of applicable independent claims. And through a method for operating an ignition device of the aforementioned type with the characterizing features of applicable independent claims, as well as through a method for igniting an air/fuel mixture of the aforementioned kind with the characterizing features of the claims. Advantageous variants of the invention are described in the further claims.

The above and other objects, which will be apparent to those skilled in the art, are achieved in the present invention which is directed to an ignition device for igniting an air/fuel mixture in at least one combustion chamber of an internal combustion engine, having at least one ignition system with electrodes for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein k high-frequency voltage sources are provided, with $k \in \mathbb{N}$ and $k < m$, wherein at least one power distributor device is provided which is electrically connected, on the one hand, to at least one high-frequency voltage source and, on the other hand, to n ignition systems, wherein $n \in \mathbb{N}$ and $2 \leq n \leq m$, wherein the power distributor device transmits the high-frequency alternating voltage or voltages from the high-frequency voltage source or sources electrically connected to this power distributor device to the n ignition systems which are electrically connected to this power distributor device, wherein at least one power distributor device is designed such that during operation of the ignition device this temporarily electrically connects the output of at least one high-frequency voltage source which is electrically connected to this power distributor device to in each case p ignition systems of the n ignition systems, at separate times, in succession, wherein $2 \leq p \leq n-1$, $m \geq 3$ and $n \geq 3$.

At least one power distributor device is preferably designed such that during operation of the ignition device this electrically connects the output of at least one high-frequency voltage source which is electrically connected to this power distributor device permanently to all n ignition systems.

At least one power distributor device may be designed such that during operation of the ignition device this temporarily electrically connects the output of at least one high-frequency voltage source which is electrically connected to this power distributor device to all n ignition systems simultaneously.

At least one power distributor device may further be designed such that during operation of the ignition device this electrically connects the output of at least one high-frequency voltage source which is electrically connected to this power distributor device with in each case one of the n ignition systems, in succession and temporarily, for a predetermined time interval.

The at least one power distributor device is electrically connected to q high-frequency voltage sources, wherein $q \in \mathbb{N}$, and $q \leq k$, wherein the power distributor device is designed in the form of a q-to-n-demultiplexer.

The m high-voltage sources are provided and the output of in each case one high-voltage source is electrically connected to in each case one ignition system.

At least one high-frequency voltage source which is electrically connected to n ignition systems may be designed such that during operation of the ignition device this permanently outputs the electrical high-frequency alternating voltage at its output.

Moreover, the at least one high-voltage source may be designed in the form of an ignition coil.

In a second aspect, the present invention is directed to a method for igniting an air/fuel mixture in m combustion chambers with $m \in \mathbb{N}$ (natural numbers without zero) and $m \geq 2$, of an internal combustion engine, wherein, within a predetermined time interval, an ignitable mixture is generated in at least one combustion chamber, wherein, by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, wherein the electrical high-frequency alternating voltage is fed to the at least two electrodes in the at least one combustion chamber with ignitable mixture before generation of the electrically conductive channel between the at least two electrodes of the respective combustion chamber, and wherein, after a predetermined time interval following the generation of the plasma, the electrical high-frequency alternating voltage is, for at least a predetermined dead time, shut off from at least those at least two electrodes of a respective combustion chamber via which the plasma was generated, wherein the predetermined dead time amounts to 0.5 ms to 2 ms.

In this method, the electrical high-frequency alternating voltage is also fed to the at least two electrodes of at least one such combustion chamber in which no ignitable mixture is present.

The predetermined dead time amounts to 1 ms.

In a third aspect, the present invention is directed to a method for operating an ignition device for igniting an air/fuel mixture in at least one combustion chamber, of an internal combustion engine, having at least one ignition system for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein the electrical high-frequency alternating voltage at the output of a high-frequency voltage source is fed to n ignition systems, wherein $n \in \mathbb{N}$ and $2 \leq n \leq m$, wherein the output of at least one high-frequency voltage source is electrically connected at separate times, in succession and temporarily, with in each case p ignition systems of the n ignition systems, wherein $2 \leq p \leq n-1$, $m \geq 3$ and $n \geq 3$.

In this method, the output of at least one high-frequency voltage source is permanently electrically connected to all n ignition systems.

The output of at least one high-frequency voltage source is temporarily electrically connected to all n ignition systems simultaneously.

Furthermore, the output of at least one high-frequency voltage source may be electrically connected, in succession and temporarily, for a predetermined time interval, with in each case one of the n ignition systems.

The at least one high-frequency voltage source is electrically connected to q power distributor devices, wherein $q \in \mathbb{N}$, and $q \leq k$.

The m high-voltage sources are provided and the output of in each case one high-voltage source is electrically connected to in each case one ignition system.

The electrical high-frequency alternating voltage is permanently output at the output of at least one high-frequency voltage source.

In a fourth aspect, the present invention is directed to a method for igniting an air/fuel mixture in m combustion chambers with $m \in \mathbb{N}$ (natural numbers without zero) and $m \geq 2$, of an internal combustion engine, wherein, within a predetermined time interval, an ignitable mixture is generated in at least one combustion chamber, wherein; by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, wherein the electrical high-frequency alternating voltage is also fed to the at least two electrodes of at least one such combustion chamber in which no ignitable mixture is present.

The electrical high-frequency alternating voltage is fed to the at least two electrodes in the at least one combustion chamber with ignitable mixture before generation of the electrically conductive channel between the at least two electrodes of the respective combustion chamber.

Furthermore, after a predetermined time interval following the generation of the plasma, the electrical high-frequency alternating voltage is, for at least a predetermined dead time, shut off from at least those at least two electrodes of a respective combustion chamber via which the plasma was generated.

The predetermined dead time amounts to 0.5 ms to 2 ms, in particular 1 ms.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
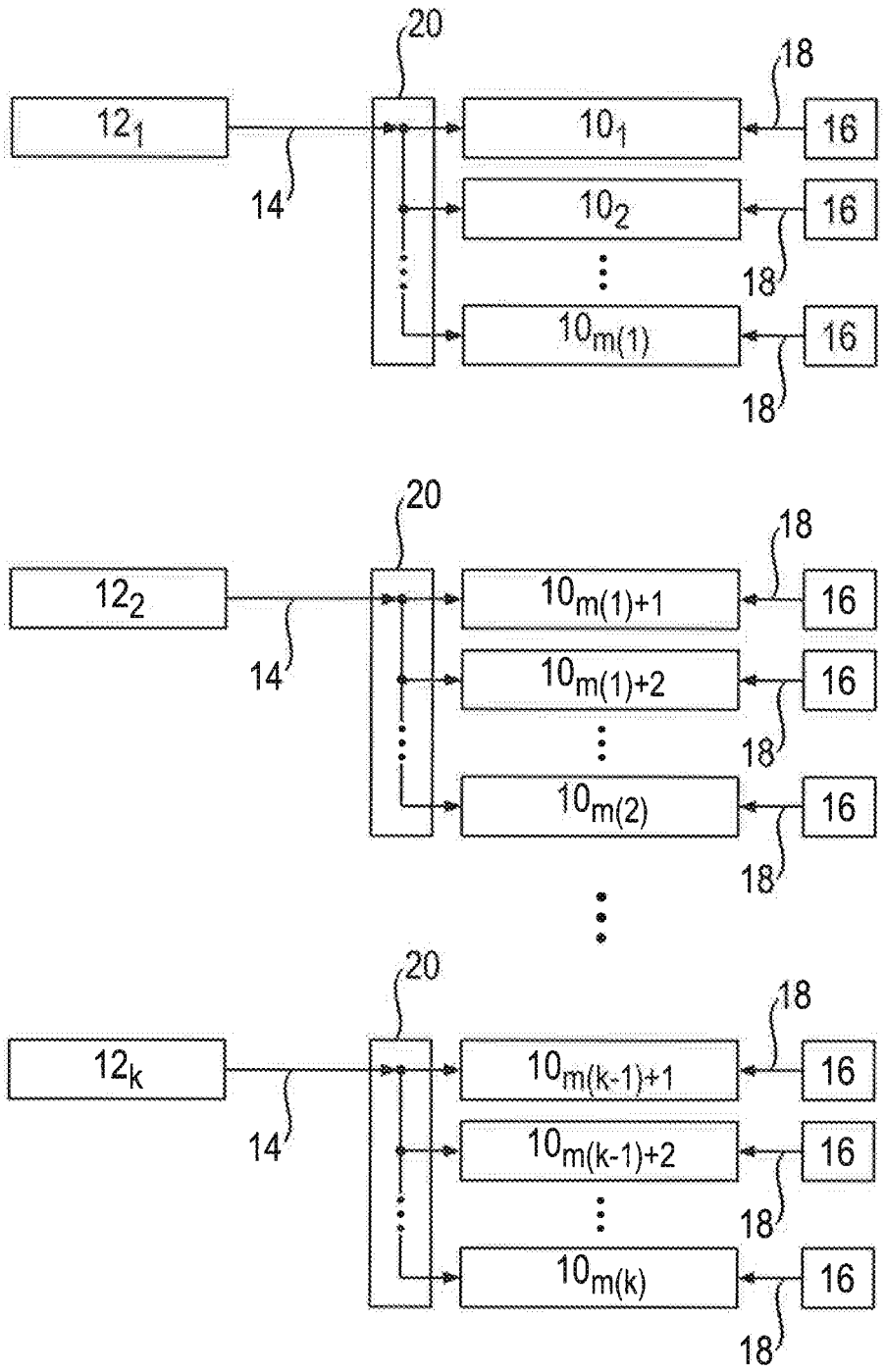
FIG. 1 shows a schematic block diagram of a first preferred embodiment of an ignition system according to the invention.

In describing the preferred embodiment of the present invention, reference will be made herein to FIGS. 1-5 of the drawings in which like numerals refer to like features of the invention.

In an ignition device of the aforementioned type according to the invention at least one power distributor device is designed such that during operation of the ignition device this temporarily electrically connects the output of at least one high-frequency voltage source which is electrically connected to this power distributor device to in each case p ignition systems of the n ignition systems, at separate times, in succession, wherein $2 \leq p \leq n-1$, $m \geq 3$ and $n \geq 3$.

This has the advantage that one high-frequency voltage source can be used for several spark plugs, resulting in a reduction in the hardware required, wherein a controlled supply of the high-frequency energy to respective groups of spark plugs is provided.

A particularly simple and economical power distributor device is achieved in that at least one power distributor device is designed such that during operation of the ignition device this permanently electrically connects the output of at least one high-frequency voltage source which is electrically connected to this power distributor device to all n ignition systems.

A reduction in the high-frequency energy needed is achieved in that at least one power distributor device is designed such that during operation of the ignition device this temporarily, for a predetermined time interval, electrically connects the output of at least one high-frequency voltage source which is electrically connected to this power distributor device to all n ignition systems simultaneously.

A controlled supply of the high-frequency energy is achieved in that at least one power distributor device is designed such that during operation of the ignition device this temporarily, for a predetermined time interval, electrically connects the output of at least one high-frequency voltage source which is electrically connected to this power distributor device in each case to one of the n ignition systems in succession.

A further reduction of the hardware requirement is achieved in that at least one power distributor device is electrically connected to q high-frequency voltage sources, wherein $q \in \mathbb{N}$, and $q \leq k$, wherein the power distributor device is designed in the form of a q-to-n-demultiplexer.

An individual and exactly-timed supply of a high-voltage pulse to a respective spark plug is achieved in that m high-voltage sources are provided and the output of in each case one high-voltage source is electrically connected to in each case one ignition system.

A further simplification of the requirements in terms of circuitry and control technology is achieved in that at least one high-frequency voltage source which is electrically connected to n spark plugs is designed such that during operation of the ignition device this permanently outputs the electrical high-frequency alternating voltage at its output.

The use of already-existing components for the ignition device according to the invention is made possible in that at least one high-voltage source is designed in the form of an ignition coil.

In a method for igniting an air/fuel mixture of the aforementioned type, according to the invention, after a predetermined time interval following the generation of the plasma, the electrical high-frequency alternating voltage is, for at least a predetermined dead time, shut off from at least those at least two electrodes of a respective combustion chamber via which the plasma was generated, wherein the predetermined dead time amounts to 0.5 ms to 2 ms.

This has the advantage that a reliable extinction of the plasma is achieved, so that a new ignitable mixture can be generated in the respective combustion chamber with plasma for a renewed ignition.

A simplification of the ignition system using only one source for the electrical high-frequency alternating voltage for several combustion chambers is achieved in that the electrical high-frequency alternating voltage is also fed to the at least two electrodes of at least one such combustion chamber in which no ignitable mixture is present.

Optionally, the predetermined dead time amounts to 0.5 ms to 2 ms, in particular 1 ms.

In a method for operating an ignition device for igniting an air/fuel mixture of the aforementioned type, according to the invention, the output of at least one high-frequency voltage source is electrically connected at separate times, in succession and temporarily, with in each case p ignition systems of the n ignition systems, wherein $2 \leq p \leq n-1$, $m \geq 3$ and $n \geq 3$.

This has the advantage that one high-frequency voltage source can be used for several ignition systems, resulting in a reduction in the hardware required, wherein a controlled supply of the high-frequency energy to respective groups of spark plugs is provided.

A particularly simple and economical power distributor device is achieved in that the output of at least one high-frequency voltage source is permanently electrically connected to all n ignition systems.

A reduction in the necessary high-frequency energy is achieved in that the output of at least one high-frequency voltage source is temporarily electrically connected to all n ignition systems simultaneously.

A controlled supply of the high-frequency energy is achieved in that the output of at least one high-frequency voltage source is temporarily, for a predetermined time interval, electrically connected in each case to one of the n ignition systems in succession.

A further reduction of the hardware requirement is achieved in that at least one high-frequency voltage source is electrically connected to q power distributor devices, wherein $q \in \mathbb{N}$, and $q \leq k$.

An individual and exactly-timed supply of a high-voltage pulse to a respective spark plug is achieved in that m high-voltage sources are provided and the output of in each case one high-voltage source is electrically connected to in each case one ignition system.

A further simplification of the requirements in terms of circuitry and control technology is achieved in that at least one high-frequency voltage source permanently outputs the electrical high-frequency alternating voltage at its output.

In a method for igniting an air/fuel mixture in m combustion chambers, according to the invention the electrical high-frequency alternating voltage is also fed to the at least two electrodes of at least one such combustion chamber in which no ignitable mixture is present.

This has the advantage that a simplification of the ignition system using only one source for the electrical high-frequency alternating voltage for several combustion chambers is achieved.

The generation or maintenance of the plasma automatically immediately following generation of the electrically conductive channel, without this requiring an external trigger for the electrical high-frequency alternating voltage, is achieved in that the electrical high-frequency alternating voltage is fed to the at least two electrodes in the at least one combustion chamber with ignitable mixture before generation of the electrically conductive channel between the at least two electrodes of the respective combustion chamber.

An extinction of the plasma such that a new ignitable mixture can be generated in the respective combustion chamber with plasma for a renewed ignition is achieved in that, after a predetermined time interval following the generation of the plasma, the electrical high-frequency alternating voltage is, for at least a predetermined dead time, shut off from at least those at least two electrodes of a respective combustion chamber via which the plasma was generated.

Optionally, the predetermined dead time amounts to 0.5 ms to 2 ms, in particular 1 ms.

The invention is explained in more detail in the following with reference to the drawings.

Figure 2:
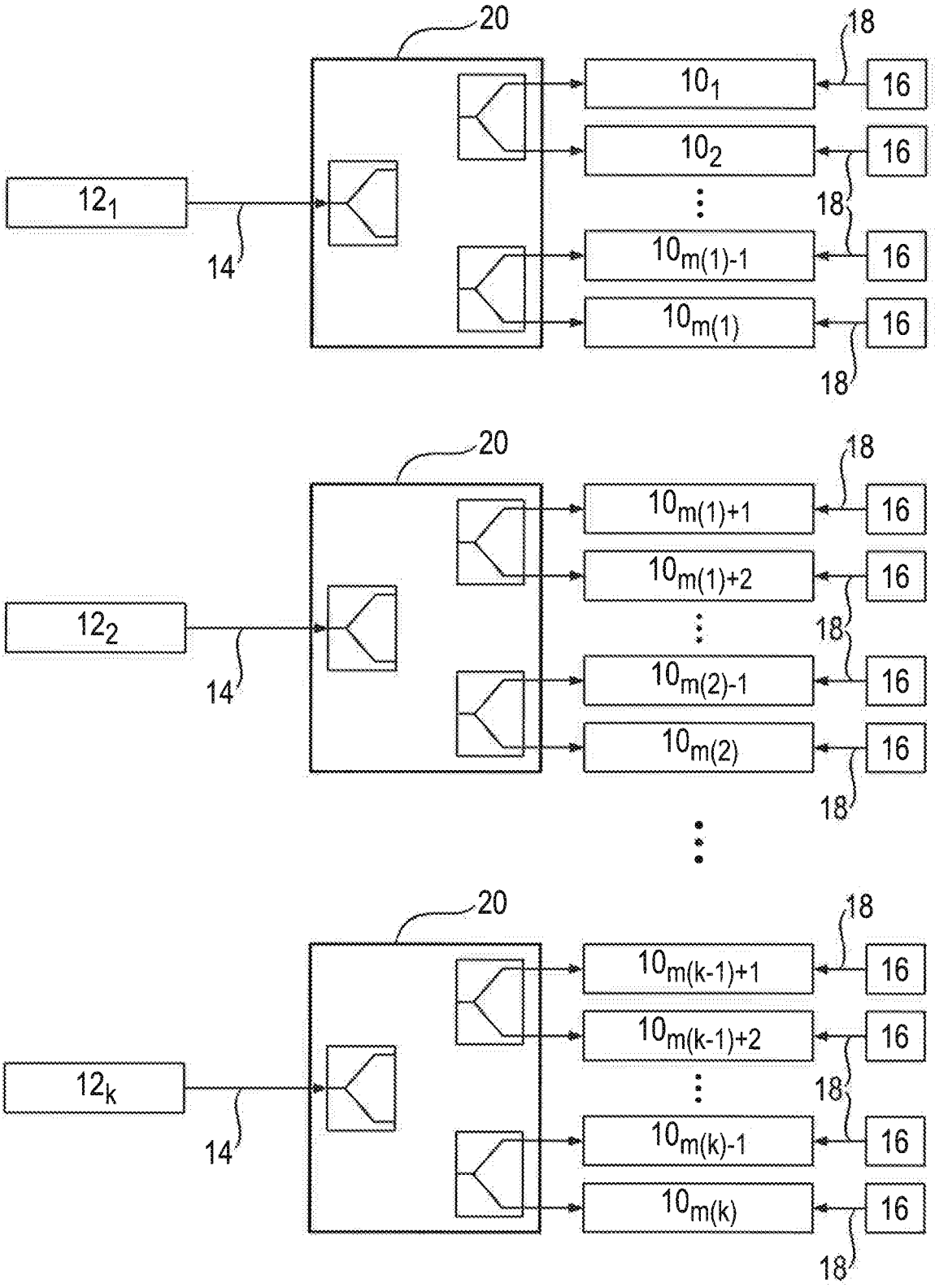
FIG. 2 shows a schematic block diagram of a second preferred embodiment of an ignition system according to the invention.
Figure 3:
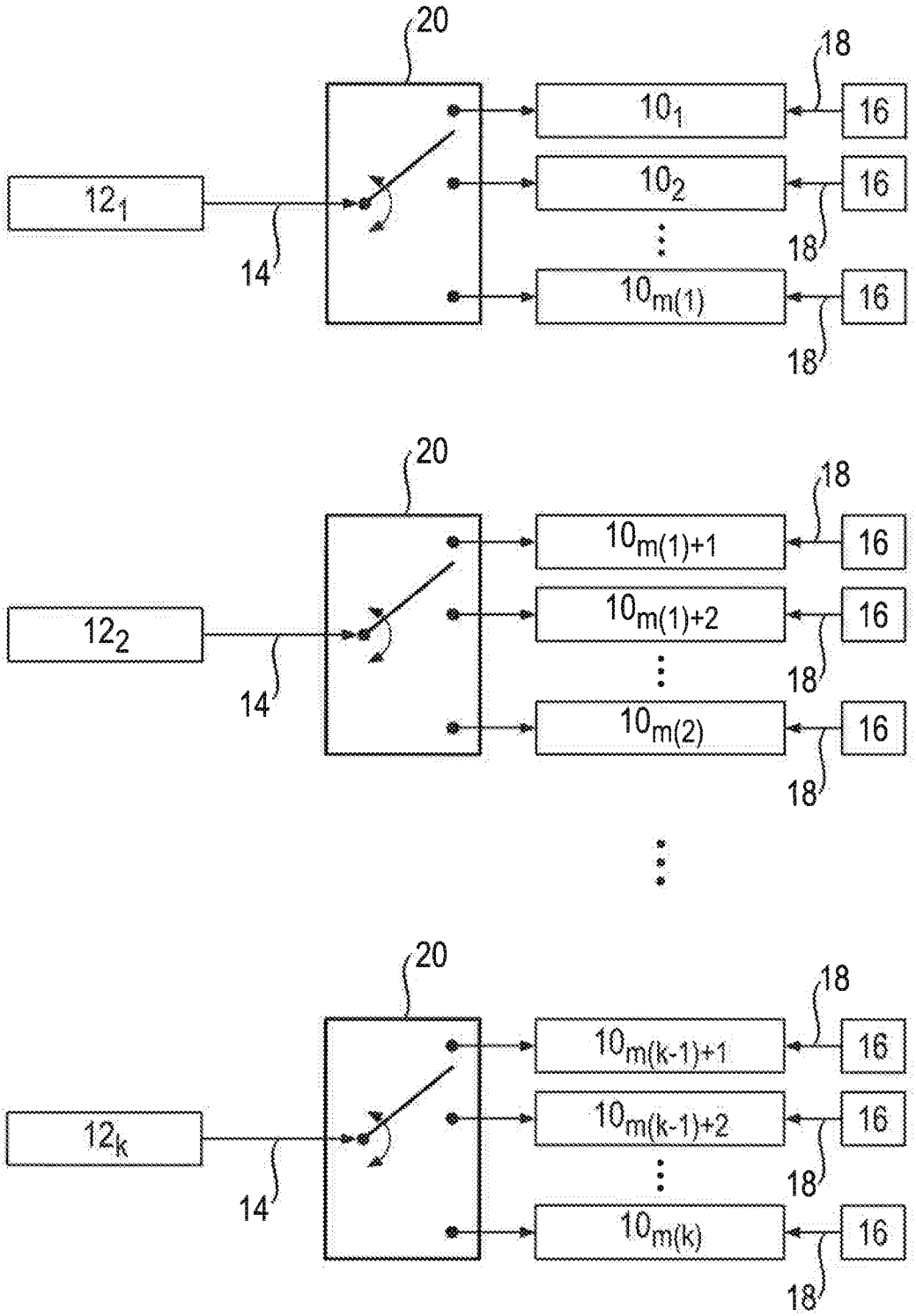
FIG. 3 shows a schematic block diagram of a third preferred embodiment of an ignition system according to the invention.

The three preferred embodiments of an ignition device according to the invention illustrated in FIGS. 1 to 3 in each case comprise m ignition systems $\mathbf{10}_i$, i=1, . . . m, with m∈ ℕ (natural numbers without zero) and k high-frequency voltage sources $\mathbf{12}_j$, j=1, . . . k with k∈ℕ, and k<m. Accordingly, the m ignition systems $\mathbf{10}_1$, $\mathbf{10}_2$, . . . $\mathbf{10}_{m(1)}$, $\mathbf{10}_{m(1)+1}$, $\mathbf{10}_{m(1)+2}$, $\mathbf{10}_{m(2)}$, $\mathbf{10}_{m(k-1)+1}$, $\mathbf{10}_{m(k-1)+2}$, $\mathbf{10}_{m(k)}$ with m(k)=m and the k high-frequency voltage sources $\mathbf{12}_1$, $\mathbf{12}_2$, . . . $\mathbf{12}_k$, are represented in FIGS. 1 to 3. Each high-frequency voltage source $\mathbf{12}_j$ supplies an electrical high-frequency alternating voltage 14 at the respective output. The ignition system $\mathbf{10}_i$ is in each case fed a high-voltage pulse 18 from one or more high-voltage sources 16 according to a predetermined timing.

Each ignition system is assigned to a combustion chamber, for example of an internal combustion engine, so that in the present example the internal combustion engine has m combustion chambers. Each ignition system has for example at least two, three or more electrodes which are for example structured in the form of a spark plug, wherein the electrodes project into the respective combustion chamber.

As is well known, in an internal combustion engine an ignitable mixture is generated in one or more combustion chambers at a particular point in time and the energy for an ignition spark is fed to the ignition system $\mathbf{10}_i$ associated with these combustion chambers in the form of the high-voltage pulse 18. This is intended to generate an ignition spark between the electrodes in the respective combustion chamber and so ignite the ignitable mixture. The ignition spark forms an electrically conductive channel between the electrodes. With the ignition spark alone, this electrically conductive channel or the ignition spark collapses immediately once the energy for the ignition spark has been consumed.

By means of the high-frequency alternating voltage 14, which is also fed to the ignition system $\mathbf{10}_i$ and thus the electrodes, the electrically conductive channel is now used to maintain this by means of the energy from the high-frequency alternating voltage 14 and to generate a plasma between the electrodes and in the respective combustion chamber and maintain it over a period of time which is longer than [the period during which] the conductive channel would be maintained by the actual ignition spark, so that the ignition spark in the form of the plasma is available for a longer period for ignition of the ignitable mixture. The spatial extent of the plasma is also increased. As a result, a more reliable and homogenous ignition of the ignitable mixture is achieved. Only with disconnection of the high-frequency alternating voltage 14 from the respective ignition system $\mathbf{10}_i$ which is currently maintaining a plasma in its combustion chamber is the plasma extinguished and the ignition process completed.

According to the invention, fewer high-frequency voltage sources $\mathbf{12}_j$ are provided than ignition systems $\mathbf{10}_i$. In other words, the number k of high-frequency voltage sources $\mathbf{12}_j$ is less than the number m of ignition systems $\mathbf{10}_i$ (k<m). In order, nonetheless, to supply each ignition system $\mathbf{10}_i$ with a high-frequency alternating voltage 14, according to the invention at least one power distributor device 20 is provided. This is, on the one hand, connected electrically to at least one high-frequency voltage source $\mathbf{12}_j$ and, on the other hand, to n ignition systems $\mathbf{10}_i$, wherein n∈ℕ and 2≤n≤m, wherein the power distributor device 20 transmits the high-frequency alternating voltage or voltages 14 from the high-frequency voltage source or sources $\mathbf{12}_j$ which is/are electrically connected to this/these power distributor device(s) 20 to the n ignition systems $\mathbf{10}_i$ which are electrically connected to this power distributor device 20.

In the exemplary illustration, the ignition systems $\mathbf{10}_1$, . . . $\mathbf{10}_{m(1)}$, are electrically connected via a power distributor device 20 to the high-frequency voltage source $\mathbf{12}_1$, the ignition systems $\mathbf{10}_{m(1)+1}$, $\mathbf{10}_{m(1)+2}$, . . . $\mathbf{10}_{m(2)}$ are electrically connected via a further power distributor device 20 to the high-frequency voltage source $\mathbf{12}_2$ and the ignition systems $\mathbf{10}_{m(k-1)+1}$, $\mathbf{10}_{m(k-1)+2}$, . . . $\mathbf{10}_{m(k)}$ (wherein m(k)=m) are electrically connected via a further power distributor device 20 to the high-frequency voltage source $\mathbf{12}_k$.

Generally, the ignition systems $\mathbf{10}_{m(j-1)+1}$, $\mathbf{10}_{m(j-1)+2}$, . . . $\mathbf{10}_{m(j)}$ are connected to the high-frequency voltage source $\mathbf{12}_j$, wherein m(0)=0, m(k)=m, j=1, k and 2≤[m(j)−m(j−1)]≤n≤m and 0≤m(j)≤m and m(j+1)>m(j). In this way, the output or the high-frequency alternating voltage 14 from a single high-frequency voltage source $\mathbf{12}_j$ is used for several ignition systems $\mathbf{10}_{m(j+1)+1}$, $\mathbf{10}_{m(j+1)+2}$, . . . $\mathbf{10}_{m(j)}$.

In the representation in FIGS. 1 to 3, a separate high-voltage source 16 for generation of the initial ignition spark is shown for each of the ignition systems $\mathbf{10}_{m(j-1)+1}$, $\mathbf{10}_{m(j-1)+2}$, . . . $\mathbf{10}_{m(j)}$ assigned to the high-frequency voltage source $\mathbf{12}_j$. However, this is simply exemplary. Alternatively, a central energy source can also be provided for generation of the ignition spark or of the electrically conductive channel, wherein an ignition distributor transmits the energy from the energy source to the respective ignition system $\mathbf{10}_{m(j-1)+1}$, $\mathbf{10}_{m(j-1)+2}$, . . . $\mathbf{10}_{m(j)}$.

An exemplary configuration for a 4-cylinder petrol engine would be k=1 and m=4, i.e. one high-frequency voltage source $\mathbf{12}_1$ and four cylinders, each with one combustion chamber and ignition systems $\mathbf{10}_1$, $\mathbf{10}_2$, $\mathbf{10}_3$, $\mathbf{10}_4$, assigned to these combustion chambers (one ignition system for each combustion chamber).

Some or all ignition systems $\mathbf{10}_i$ are for example designed in the form of 2-electrode ignition systems, preferably in the form of spark plugs. The high-voltage pulse 18 and the high-frequency alternating voltage 14 are hereby passed to an electrode directly or via an isolating element, wherein the other electrode is connected to a fixed potential, for example ground. Alternatively, the high-voltage pulse 18 is fed directly or via an isolating element to one electrode and the high-frequency alternating voltage 14 is fed directly or via an isolating element to the other electrode.

Alternatively, some or all ignition systems $\mathbf{10}_1$ are designed in the form of 3-electrode ignition systems, preferably in the form of spark plugs. The high-voltage pulse 18 is fed directly or via an isolating element to a first electrode. The high-frequency alternating voltage 14 is fed directly or via an isolating element to a second electrode. A third electrode is connected to a fixed potential, for example ground.

A high-frequency plasma is only formed if an initial charge carrier channel is also present, which in the present case is generated by the ignition spark.

In the first embodiment according to FIG. 1 the power distributor device 20 is designed in the form of a simple node point which permanently connects all ignition systems $\mathbf{10}_{m(j-1)+1}$, $\mathbf{10}_{m(j-1)+2}$, . . . $\mathbf{10}_{m(j)}$ electrically to the output of the high-frequency voltage source $\mathbf{12}_j$, so that a high-frequency alternating voltage 14 output by the high-frequency voltage source $\mathbf{12}_j$ at the output is passed on electrically directly to all ignition systems $\mathbf{10}_{m(j-1)+1}$, $\mathbf{10}_{m(j-1)+2}$, . . . $\mathbf{10}_{m(j)}$. In other words, this means that the high-frequency alternating voltage 14 from the high-frequency voltage source $\mathbf{12}_j$ is applied to all ignition systems $\mathbf{10}_{m(j-1)+1}$, $\mathbf{10}_{m(j-1)+2}$, $\mathbf{10}_{m(j)}$ as long as this is output from the high-frequency voltage source $\mathbf{12}_j$ at its output.

In the second embodiment according to FIG. 2, the power distributor device 20 is designed in the form of a passive power splitter. This achieves an improved matching of the impedance between the output of the high-frequency voltage source $\mathbf{12}_j$ and the input of the ignition systems $\mathbf{10}_i$. The passive power splitter is for example designed in the form of a Wilkinson power divider or directional coupler. As in the first embodiment, in this second embodiment too all ignition systems $\mathbf{10}_{m(j-1)+1}$, $\mathbf{10}_{m(j-1)+2}$, . . . $\mathbf{10}_{m(j)}$ are permanently electrically connected to the output of the high-frequency voltage source $\mathbf{12}_j$, so that a high-frequency alternating voltage 14 output by the high-frequency voltage source $\mathbf{12}_i$ at the output is passed on electrically directly to all ignition systems $\mathbf{10}_{m(j-1)+1}$, $\mathbf{10}_{m(j-1)+2}$, . . . $\mathbf{10}_{m(j)}$. In other words, this means that the high-frequency alternating voltage 14 from the high-frequency voltage source $\mathbf{12}_j$ is applied to all ignition systems $\mathbf{10}_{m(j-1)+1}$, $\mathbf{10}_{m(j-1)+2}$, . . . $\mathbf{10}_{m(j)}$ as long as high-frequency alternating voltage 14 is output from the high-frequency voltage source $\mathbf{12}_j$ at its output.

In the third embodiment according to FIG. 3, the power distributor device 20 is designed in the form of a demultiplexer. In contrast to the first and second embodiments, the output from the high-frequency voltage source $\mathbf{12}_j$ is not permanently electrically connected to all ignition systems $\mathbf{10}_{m(j-1)+1}$, $\mathbf{10}_{m(j-1)+2}$, . . . $\mathbf{10}_{m(j)}$. Instead, the 1-to-[m(j)-n (j−1)] demultiplexer always in each case only connects one of the ignition systems $\mathbf{10}_{m(j-1)+1}$, $\mathbf{10}_{m(j-1)+2}$, . . . $\mathbf{10}_{m(j)}$ to the output of the high-frequency voltage source $\mathbf{12}_j$, so that, at any given point in time, the high-frequency alternating voltage 14 is always only transmitted to one ignition system of the several ignition systems $\mathbf{10}_{m(j-1)+1}$, $\mathbf{10}_{m(j-1)+2}$, . . . $\mathbf{10}_{m(j)}$ assigned to the high-frequency voltage source $\mathbf{12}_j$. As a result, the requirements placed on the high-frequency voltage source $\mathbf{12}_j$ are reduced, so that this can be made simpler. For example, the dimensioning of the high-frequency voltage source 12) can be reduced.

Before or during the ignition of an ignition system $\mathbf{10}_i$, the demultiplexer switches the high-frequency alternating voltage 14 exclusively to precisely this ignition system depending on a control signal, which is for example provided by an engine control system. The advantage in comparison with the direct parallel connection of the high-frequency voltage source $\mathbf{12}_j$ to all ignition systems $\mathbf{10}_{m(j-1)+1}$, $\mathbf{10}_{m(j-1)+2}$, . . . $\mathbf{10}_{m(j)}$ is that, due to the high-impedance shutoff by the demultiplexer, those ignition systems in which no ignition is supposed to take place do not represent a load on the high-frequency voltage source $\mathbf{12}_j$. Thus, only one/a few high-frequency voltage sources $\mathbf{12}_j$ with reduced requirements is/are required.

Irrespective of the specific embodiment of the power distributor device 20 according to FIGS. 1 to 3, the invention provides for an efficient distribution of a high-frequency signal (high-frequency alternating voltage 14) in an HF-supported ignition system for internal combustion engines in order to reduce the number of energy sources (k=number of HF amplifiers (high-frequency voltage sources 12*j*), m=number of operated ignition systems $\mathbf{10}_i$, $k<m$, $k\geq 1$, $m\geq 2$, $k, m\in\mathbb{N}$).

Figure 4:
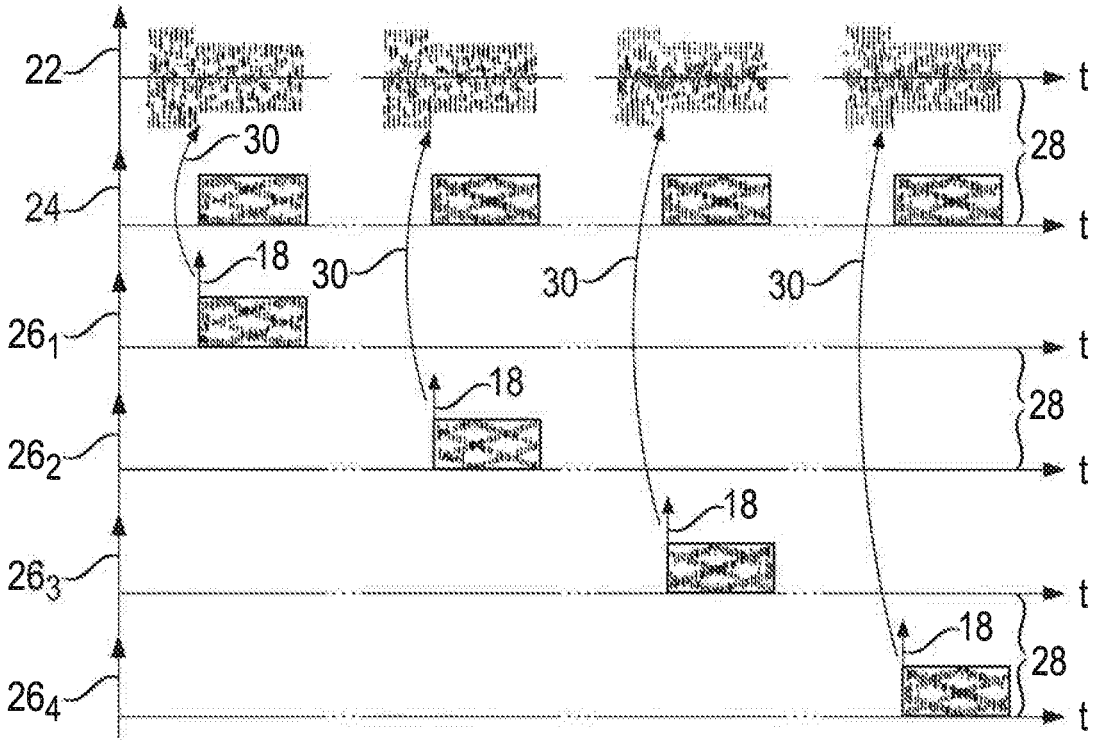
FIG. 4 shows a development over time of the high-frequency alternating voltage, output effective power of a high-frequency voltage source and effective power in a plasma for an ignition system with one high-frequency voltage source and four ignition systems

An exemplary configuration for a 4-cylinder-petrol engine would, as mentioned above, be k=1 and m=4, i.e. one high-frequency voltage source $\mathbf{12}_1$ and four ignition systems $\mathbf{10}_i$ (i=1, 2, 3, 4), one ignition system for each combustion chamber of a cylinder of the internal combustion engine. All four ignition systems $\mathbf{10}_i$ are electrically connected via the power distributor device 20 to the high-frequency voltage source $\mathbf{12}_1$. In this case therefore, n=4=m. For this configuration, a development over time of the voltage $U_{HF}$ 22 at the output of the high-frequency voltage source $\mathbf{12}_1$, the output effective power $P_{HF}$ 24 of the high-frequency voltage source $\mathbf{12}_1$ and the effective power $P_{KI,i}$ 26*i* in the plasma for the i-th ignition system $\mathbf{10}_i$, with in this example i=1, 2, 3, 4, over a time axis 28 is represented in FIG. 4. The voltage amplitude of the high-frequency alternating voltage 14 is not high enough to ignite a plasma in itself. Only in combination with an ignition pulse (high-voltage pulse 18) is an initial ignition spark provided, i.e., an electrically conductive channel, to which the high-frequency alternating voltage 14 (HF signal) is applied and generates a high-frequency plasma in that additional energy is introduced, as a result of which the HF voltage falls due to the change in impedance (indicated in each case with an arrow 30). Without the ignition pulse (high-voltage pulse 18) in one system or the other systems (ignition system $\mathbf{26}_1$, $\mathbf{26}_2$, $\mathbf{26}_3$ or $\mathbf{26}_4$), the high-frequency alternating voltage 14 has no effect in this and can be applied to the electrodes of this or these systems during the other process steps in a cycle of the internal combustion engine without any problem. The high-frequency alternating voltage 14 can therefore be applied simultaneously to all ignition systems $\mathbf{26}_1$, $\mathbf{26}_2$, $\mathbf{26}_3$, $\mathbf{26}_4$. Between two successive ignitions in the ignition systems $\mathbf{26}_1$, $\mathbf{26}_2$, $\mathbf{26}_3$, $\mathbf{26}_4$ which are electrically connected to the high-frequency voltage source $\mathbf{12}_1$, the high-frequency alternating voltage 14 is cut off (dead time), so that the plasma is extinguished rather than continuing to burn continuously. The high-frequency alternating voltage 14 is for example cut off for a time interval of around 1 ms so that no undesired plasma generation takes place due to free charge carriers of the last plasma still being present. As can be seen from FIG. 4, a plasma is first ignited in the first ignition system $\mathbf{26}_1$ and this plasma is extinguished through cutting-off of the high-frequency alternating voltage 14. A plasma is then in each case successively ignited and extinguished again in the second ignition system $\mathbf{26}_2$, the third ignition system $\mathbf{26}_3$ and the fourth ignition system $\mathbf{26}_4$.

For the case that, due to the necessary timing sequence of the plasma ignitions, the dead time for extinction of one plasma in the ignition system $\mathbf{26}_1$, would overlap in time with the ignition of a plasma in the next ignition system $\mathbf{26}_{i+1}$ or $\mathbf{26}_{i+x}$, more than one high-frequency voltage source $\mathbf{12}_j$ is provided, and the ignition systems which would overlap in time with respect to dead time and plasma ignition are assigned to different high-frequency voltage sources $\mathbf{12}_j$. This is for example the case if the number of cylinders is so great that the ignition pulse of one ignition system falls within the dead time of the preceding ignition system. In this case a plasma would, undesirably, be generated in both ignition systems. In this case, at least two high-frequency voltage sources $\mathbf{12}_1$ and $\mathbf{12}_2$ are therefore provided.

Figure 5:
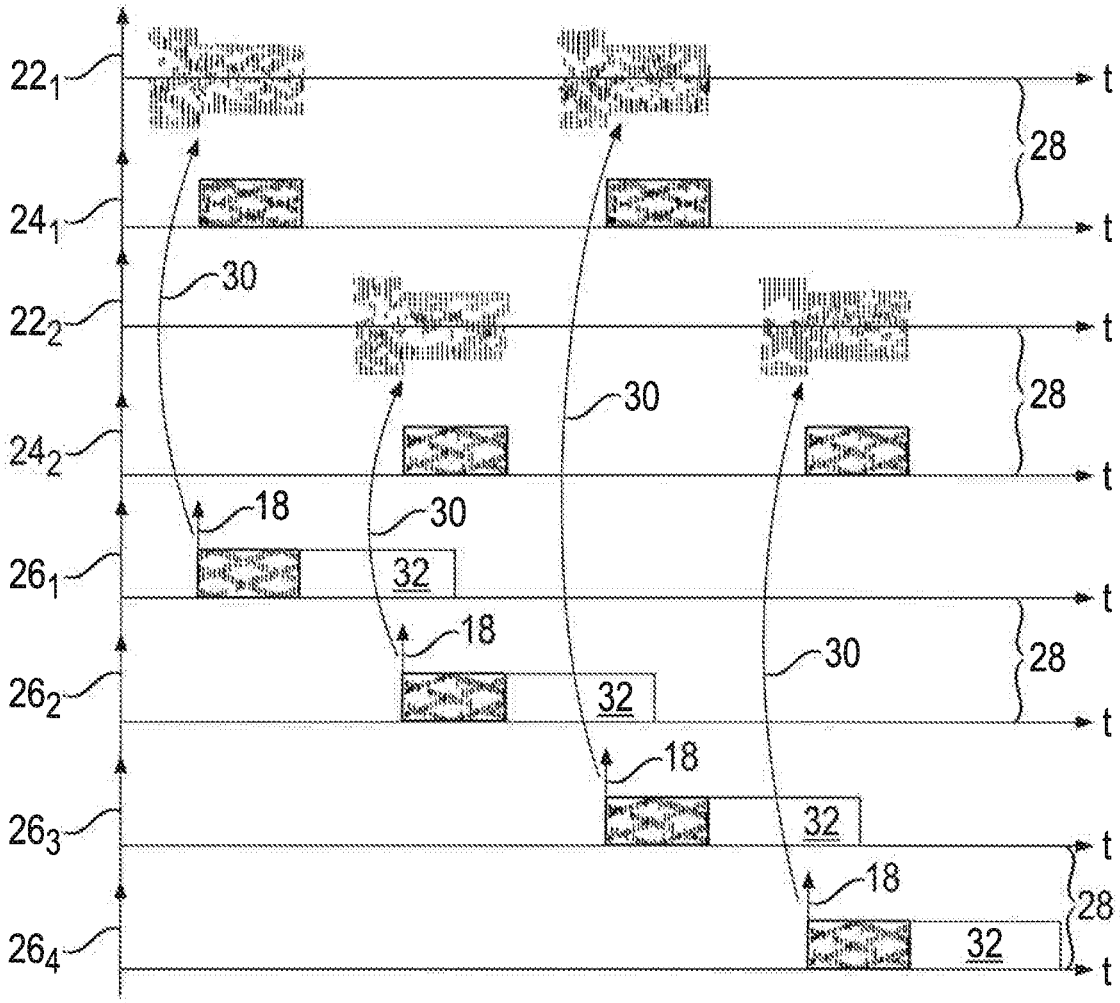
FIG. 5 shows a development over time of the high-frequency alternating voltage, output effective power of high-frequency voltage sources and effective power in a plasma for an ignition system with two high-frequency voltage sources and four ignition systems.

The resulting development over time of the voltage $U_{HF}$ 22 at the output of the high-frequency voltage source $\mathbf{12}_1$, the output effective power $P_{HF}$ 24 of the high-frequency voltage source $\mathbf{12}_1$ and the effective power $P_{PI,i}$ $\mathbf{26}_i$ in the plasma for the i-th ignition system $\mathbf{10}_i$, with in this example i=1, 2, 3, 4, over a time axis 28 is represented in FIG. 5. In FIG. 5, parts with the same function are identified with the same reference symbols as in FIG. 4, so that reference is made to the above description of FIG. 4 with regard to their explanation. In contrast to FIG. 4, two voltages $U_{HF,1}$ 221 and $U_{HF,2}$ 222 at the respective outputs of the high-frequency voltage sources $\mathbf{12}_1$ and $\mathbf{12}_2$ and two output effective powers $P_{HF,1}$ $\mathbf{24}_1$ and $P_{HF,2}$ $\mathbf{24}_2$ of the high-frequency voltage sources $\mathbf{12}_1$ and $\mathbf{12}_2$ are shown. The ignition systems $\mathbf{26}_1$ and $\mathbf{26}_3$ are electrically connected via a first power distributor device 20 to the first high-frequency voltage source $\mathbf{12}_1$ and the ignition systems $\mathbf{26}_2$ and $\mathbf{26}_4$ are electrically connected [via a] second power distributor device 20 to the second high-frequency voltage source $\mathbf{12}_2$. A necessary dead time for an ignition system $\mathbf{26}_i$ is identified with 32. This exemplary embodiment with k=2 and m=4 is simply chosen for the purpose of simple or clearer illustration and is not necessarily realistic.

As can be seen from FIG. 5, the dead time 32 of the first ignition system $\mathbf{26}_1$ overlaps in time with the high-voltage pulse 18 in the second ignition system $\mathbf{26}_2$. However, since the first ignition system $\mathbf{26}_1$ is connected to the first high-frequency voltage source $\mathbf{12}_1$ and the second ignition system $\mathbf{26}_2$ is connected to the second high-frequency voltage source $\mathbf{12}_2$, the first high-frequency voltage source $\mathbf{12}_1$ can remain cut off for the necessary dead time 32 in the first ignition system $\mathbf{26}_1$ while the second ignition system $\mathbf{26}_2$ is supplied with the high-frequency alternating voltage 14 from the second high-frequency voltage source $\mathbf{12}_2$ and with the high-voltage pulse 18. The same applies to the second and third ignition system $\mathbf{26}_2$, $\mathbf{26}_3$ and to the third and fourth ignition systems $\mathbf{26}_3$, $\mathbf{26}_4$ in terms of the timing sequence of dead times 32 and high-voltage pulses 18.

The invention also relates to a method for igniting an air/fuel mixture in m combustion chambers, with $m \in \mathbb{N}$ (natural numbers without zero) and $m \geq 2$, in particular of an internal combustion engine, wherein, within a predetermined time interval, an ignitable mixture is generated in at least one combustion chamber. By means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel. The electrical high-frequency alternating voltage is fed to the at least two electrodes in the at least one combustion chamber with ignitable mixture before generation of the electrically conductive channel between the at least two electrodes of the respective combustion chamber. This has the advantage that the generation or maintenance of the plasma takes place automatically immediately following generation of the electrically conductive channel, without this requiring an external trigger for the electrical high-frequency alternating voltage. In addition, applying the high-frequency before the time of ignition improves the take-over.

The electrical high-frequency alternating voltage is for example also fed to the at least two electrodes of at least one such combustion chamber in which no ignitable mixture is present.

After a predetermined time interval following the generation of the plasma, the electrical high-frequency alternating voltage is, for at least a predetermined dead time, shut off from at least those at least two electrodes of a respective combustion chamber via which the plasma was generated. This achieves an extinction of the plasma, so that a new ignitable mixture can be generated in the respective combustion chamber with plasma for a renewed ignition.

In a method according to the preceding paragraph, optionally, the predetermined dead time amounts to 0.5 ms to 2 ms, in particular 1 ms.

The invention also relates to a method for operating an ignition device for igniting an air/fuel mixture in at least one combustion chamber, in particular of an internal combustion engine, having at least one ignition system for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$. The electrical high-frequency alternating voltage at the output of a high-frequency voltage source is fed to n ignition systems, wherein $n \in \mathbb{N}$ and $2 \leq n \leq m$. This means that one high-frequency voltage source can be used for several ignition systems, resulting in a reduction in the necessary hardware requirements.

The output of at least one high-frequency voltage source is for example permanently electrically connected to all n ignition systems.

The output of at least one high-frequency voltage source is for example temporarily electrically connected to all n ignition systems simultaneously, which makes possible a reduction in the necessary high-frequency energy.

The output of at least one high-frequency voltage source is electrically connected, in succession and temporarily, for a predetermined time interval, with in each case one of the n ignition systems.

At least one power distributor device is preferably electrically connected to q high-frequency voltage sources, wherein $q \in \mathbb{N}$, and $q \leq k$.

The output of at least one high-frequency voltage source is for example also electrically connected at separate times, in succession and temporarily, with in each case p ignition systems of the n ignition systems, wherein $2 \leq p \leq n-1$, $m \geq 3$ and $n \geq 3$. This makes possible a controlled feed of the high-frequency energy from the high-frequency source to respective groups of spark plugs.

For example, m high-voltage sources are provided and the output of in each case one high-voltage source is electrically connected to in each case one ignition system. This makes possible an individual and exactly-timed feed of a high-voltage pulse to a respective spark plug.

The electrical high-frequency alternating voltage is permanently output at the output of at least one high-frequency voltage source. This achieves a further simplification of the requirements in terms of circuitry and control technology.

The invention also relates to a method for igniting an air/fuel mixture in m combustion chambers, with $m \in \mathbb{N}$ (natural numbers without zero) and $m \geq 2$, in particular of an internal combustion engine, wherein, within a predetermined time interval, an ignitable mixture is generated in at least one combustion chamber. By means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel. The electrical high-frequency alternating voltage is hereby also fed to the at least two electrodes of at least one such combustion chamber in which no ignitable mixture is present. The ignition system thus gets by with only one source for the electrical high-frequency alternating voltage for several combustion chambers.

The electrical high-frequency alternating voltage is for example fed to the at least two electrodes in the at least one combustion chamber with ignitable mixture before generation of the electrically conductive channel between the at least two electrodes of the respective combustion chamber. As a result, the generation or maintenance of the plasma takes place automatically immediately following generation of the electrically conductive channel, without this requiring an external trigger for the electrical high-frequency alternating voltage.

After a predetermined time interval following the generation of the plasma, the electrical high-frequency alternating voltage is, for at least a predetermined dead time, shut off from at least those at least two electrodes of a respective combustion chamber via which the plasma was generated. This results in an extinction of the plasma, so that a new ignitable mixture can be generated in the respective combustion chamber with plasma for a renewed ignition.

Optionally, in a method according to the preceding paragraph the predetermined dead time amounts to 0.5 ms to 2 ms, in particular 1 ms.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An ignition device for igniting an air/fuel mixture in at least one combustion chamber of an internal combustion engine, having at least one ignition system with electrodes for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein k high-frequency voltage sources are provided, with $k \in \mathbb{N}$ and $k < m$, wherein at least one power distributor device is provided which is electrically connected, on the one hand, to at least one high-frequency voltage source and, on the other hand, to n ignition systems, wherein $n \in \mathbb{N}$ and $2 \leq n \leq m$, wherein the power distributor device transmits the high-frequency alternating voltage or voltages from the high-frequency voltage source or sources electrically connected to this power distributor device to the n ignition systems which are electrically connected to this power distributor device, and wherein at least one power distributor device is designed such that during operation of the ignition device this temporarily electrically connects the output of at least one high-frequency voltage source which is electrically connected to this power distributor device to in each case p ignition systems of the n ignition systems, at separate times, in succession, wherein $2 \leq p \leq n-1$, $m \geq 3$ and $n \geq 3$.

2. The ignition device of claim 1, wherein at least one power distributor device is designed such that during operation of the ignition device this electrically connects the output of at least one high-frequency voltage source which is electrically connected to this power distributor device permanently to all n ignition systems.

3. The ignition device of claim 1, wherein at least one power distributor device is designed such that during operation of the ignition device this temporarily electrically connects the output of at least one high-frequency voltage source which is electrically connected to this power distributor device to all n ignition systems simultaneously.

4. The ignition device of claim 1, wherein at least one power distributor device is designed such that during operation of the ignition device this electrically connects the output of at least one high-frequency voltage source which is electrically connected to this power distributor device with in each case one of the n ignition systems, in succession and temporarily, for a predetermined time interval.

5. The ignition device of claim 1, wherein at least one power distributor device is electrically connected to q high-frequency voltage sources, wherein $q \in \mathbb{N}$, and $q \leq k$, wherein the power distributor device is designed in the form of a q-to-n-demultiplexer.

6. The ignition device of claim 1, wherein m high-voltage sources are provided and the output of in each case one high-voltage source is electrically connected to in each case one ignition system.

7. The ignition device of claim 1, wherein at least one high-frequency voltage source which is electrically connected to n ignition systems is designed such that during operation of the ignition device this permanently outputs the electrical high-frequency alternating voltage at its output.

8. The ignition device of claim 1, wherein at least one high-voltage source is designed in the form of an ignition coil.

9. A method for igniting an air/fuel mixture in m combustion chambers with $m \in \mathbb{N}$ (natural numbers without zero) and $m \geq 2$, of an internal combustion engine, wherein, within a predetermined time interval, an ignitable mixture is generated in at least one combustion chamber, wherein, by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, wherein the electrical high-frequency alternating voltage is fed to the at least two electrodes in the at least one combustion chamber with ignitable mixture before generation of the electrically conductive channel between the at least two electrodes of the respective combustion chamber, wherein, after a predetermined time interval following the generation of the plasma, the electrical high-frequency alternating voltage is, for at least a predetermined dead time, shut off from at least those at least two electrodes of a respective combustion chamber via which the plasma was generated, wherein the predetermined dead time amounts to 0.5 ms to 2 ms.

10. The method of claim 9, wherein the electrical high-frequency alternating voltage is also fed to the at least two electrodes of at least one such combustion chamber in which no ignitable mixture is present.

11. The method of claim 9, wherein the predetermined dead time amounts to 1 ms.

12. A method for operating an ignition device for igniting an air/fuel mixture in at least one combustion chamber, of an internal combustion engine, having at least one ignition system for each combustion chamber, at least one high-voltage source for generating an electrical high-voltage pulse at an output of the high-voltage source and having at least one high-frequency voltage source for generating an electrical high-frequency alternating voltage at an output of the high-frequency voltage source, wherein m ignition systems are provided, with $m \in \mathbb{N}$ (natural numbers without zero) and $m \geq 2$, wherein the electrical high-frequency alternating voltage at the output of a high-frequency voltage source is fed to n ignition systems, wherein $n \in \mathbb{N}$ and $2 \leq n \leq m$, wherein the output of at least one high-frequency voltage source is electrically connected at separate times, in succession and temporarily, with in each case p ignition systems of the n ignition systems, wherein $2 \leq p \leq n-1$, $m \geq 3$ and $n \geq 3$.

13. The method of claim 12, wherein the output of at least one high-frequency voltage source is permanently electrically connected to all n ignition systems.

14. The method of claim 12, wherein the output of at least one high-frequency voltage source is temporarily electrically connected to all n ignition systems simultaneously.

15. The method of claim 12, wherein the output of at least one high-frequency voltage source is electrically connected, in succession and temporarily, for a predetermined time interval, with in each case one of the n ignition systems.

16. The method of claim 12, wherein at least one high-frequency voltage source is electrically connected to q power distributor devices, wherein $q \in \mathbb{N}$, and $q \leq k$.

17. The method of claim 12, wherein m high-voltage sources are provided and the output of in each case one high-voltage source is electrically connected to in each case one ignition system.

18. The method of claim 12, wherein the electrical high-frequency alternating voltage is permanently output at the output of at least one high-frequency voltage source.

19. A method for igniting an air/fuel mixture in m combustion chambers with $m \in \mathbb{N}$ (natural numbers without zero) and $m \geq 2$, of an internal combustion engine, wherein, within a predetermined time interval, an ignitable mixture is generated in at least one combustion chamber, wherein, by means of an electrical high-voltage pulse, an electrically conductive channel between at least two electrodes of the respective combustion chamber is generated in the at least one combustion chamber with ignitable mixture, wherein an electrical high-frequency alternating voltage for generating and maintaining a plasma in the at least one combustion chamber with ignitable mixture is fed to the at least two electrodes with the conductive channel, wherein the electrical high-frequency alternating voltage is also fed to the at least two electrodes of at least one such combustion chamber in which no ignitable mixture is present.

20. The method of claim 19, wherein the electrical high-frequency alternating voltage is fed to the at least two electrodes in the at least one combustion chamber with ignitable mixture before generation of the electrically conductive channel between the at least two electrodes of the respective combustion chamber.

21. The method of claim 19, wherein after a predetermined time interval following the generation of the plasma, the electrical high-frequency alternating voltage is, for at least a predetermined dead time, shut off from at least those at least two electrodes of a respective combustion chamber via which the plasma was generated.

22. The method of claim 21, wherein the predetermined dead time amounts to 0.5 ms to 2 ms, in particular 1 ms.

* * * * *